US005129295A

United States Patent [19]

Geffros et al.

[11] Patent Number: 5,129,295

[45] Date of Patent: Jul. 14, 1992

[54] METHOD OF CUTTING COMPRESSIBLE MATERIALS

[75] Inventors: Mike Geffros, Port Huron, Mich.; Martin M. Levene, Kirchener, Canada

[73] Assignee: Ontario Die Company Limited, Waterloo, Canada

[21] Appl. No.: 751,608

[22] Filed: Aug. 21, 1991

Related U.S. Application Data

[63] Continuation of Ser. No. 492,994, Mar. 13, 1990, abandoned.

[51] Int. Cl.[5] ..... B26D 7/02

[52] U.S. Cl. ..... 83/19; 83/55; 83/124; 83/126; 83/128; 83/176; 83/653

[58] Field of Search ..... 83/124, 126, 176, 19, 83/128, 55, 652, 653

[56] References Cited

U.S. PATENT DOCUMENTS

| | | | |
|---|---|---|---|
| 3,765,289 | 10/1973 | Gerber et al. | 83/452 |
| 3,790,154 | 2/1974 | Gerber et al. | 269/22 |
| 3,815,221 | 6/1974 | Pearl | 29/559 |
| 4,060,016 | 11/1977 | Gerber | 83/451 |
| 4,543,862 | 10/1985 | Levene et al. | 83/19 |
| 4,672,870 | 6/1987 | Levene et al. | 83/19 |
| 4,694,719 | 9/1987 | Levene et al. | 83/451 |
| 4,825,740 | 5/1989 | Mucci, Sr. | 83/652 |
| 4,852,439 | 8/1989 | Levene et al. | 83/19 |

*Primary Examiner*—Frank T. Yost
*Assistant Examiner*—Allan M. Schrock
*Attorney, Agent, or Firm*—Krass & Young

[57] ABSTRACT

A method of cutting stacked layers of compressible material utilizing a steel rule cutting die. An open cell foam member is placed in the area between spaced portions of the cutting die to define a flat upper surface substantially flush with the sharpened upper edge of the cutting die. The stacked layers of compressible material are placed on top of the foam member and on top of the sharpened upper edge of the die and the upper platen of the associated press is lowered to precompress the stacked compressible layers prior to the cutting operation by the die. The foam member is an open cell member and has a compressibility such that it maintains a flat upper face flush with the upper cutting edge of the die during the precompression of the layers and thereafter moves downwardly in a smooth translatory manner to allow the layer to be moved downwardly through the cutting die. The invention methodology avoids distortion of the fabric pile during the cutting and allows the cutting of even very high stacks of compressible fabric without substantial variation in the shape or length of the cut pieces and without any substantial beveling of the edges of the cut pieces.

16 Claims, 3 Drawing Sheets

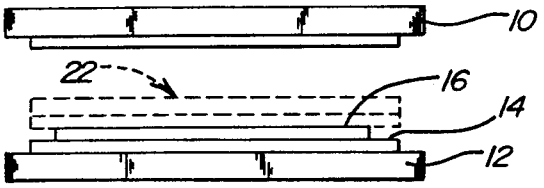
FIG - 1
FIG - 3
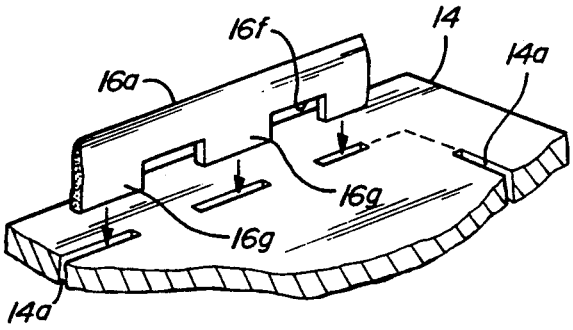
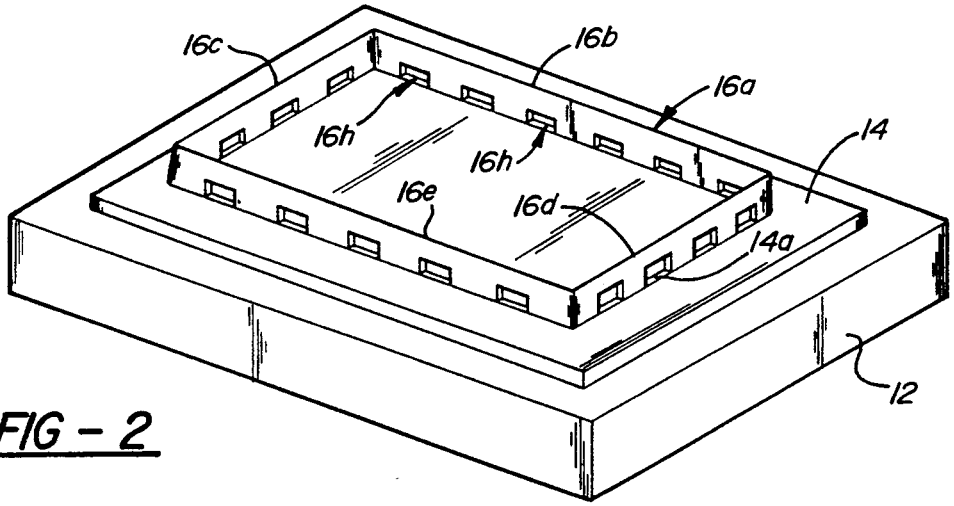
FIG - 2
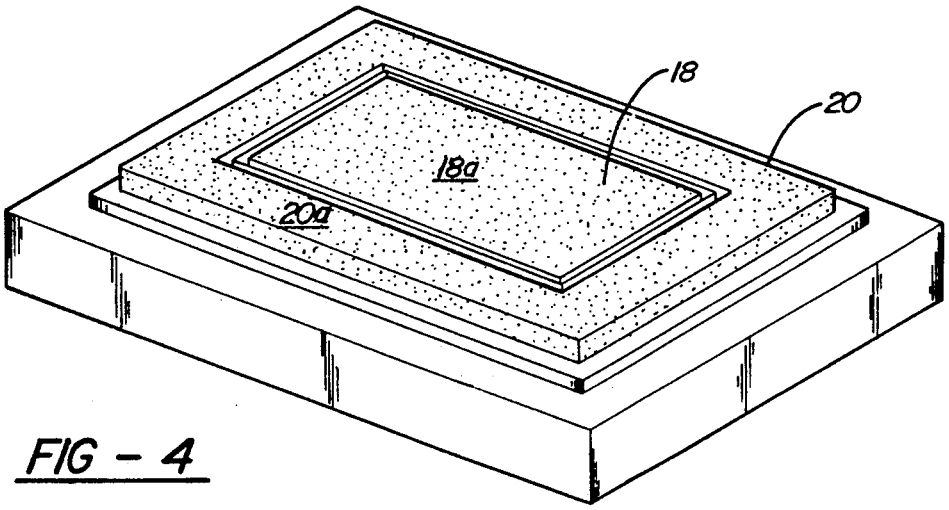
FIG - 4

WITHOUT DIEVAC DIE

WITH DIEVAC DIE

METHOD OF CUTTING COMPRESSIBLE MATERIALS

This is a continuation of co-pending application Ser. No. 492,994 filed on Mar. 13, 1990, now abandoned.

BACKGROUND OF THE INVENTION

This invention relates to steel rule die cutting and more particularly to a method for cutting stacked layers of compressible material using a steel rule die.

Steel rule dies are commonly used for cutting cloth and clothlike materials such as natural textiles, and synthetic materials such as vinyl. Steel rule dies are particularly advantageous in the repetitive cutting of specific shapes such as shirt collars, automobile interior panels and the like. In brief, a steel rule die typically comprises a base or backing board in which a groove matching the pattern to be cut is formed, and a length of steel rule embedded in the board with a sharpened exposed edge extending upwardly therefrom. The die is used in combination with a cutting table and a press which may either be single-cut or progressive feed.

A problem arises when it is necessary or desirable to cut relatively thick but compressible materials such as foam-backed vinyl, foam rubber, and plastic foam. A stack or a particularly thick single layer of such material is sufficiently unstable that an accurate cut is often not possible using conventional techniques.

One approach to the more accurate cutting of foam materials is disclosed in U.S. Pat. Nos. 3,790,154, 3,765,289 and 3,815,221, all assigned to Gerber Garment Technology, Inc. of East Hartford, Conn. These patents, and other related patents assigned to Gerber, disclose a vacuum table which is used primarily to hold sheet material in place while it is cut by a two-axis single blade jigsaw type cutter. According to these patents, a sheet of Mylar or other air impervious material can be placed over a stack of compressible materials such that the vacuum table creates a vacuum under the sheet to pull downwardly on the sheet and maintain the entire stack in a stable, compressed condition during the cutting process. In a further Gerber U.S. Pat. No. 4,060,016, the jigsaw type cutter is replaced by a rotatable turret carrying a plurality of blanking dies which are selectively rotated into position and driven downwardly through an air impervious sheet and through the stacked materials to form a stack of cut patterns corresponding t the shape of the particular die selected.

In all of the these patented systems the board on which the stacked material is located must be capable of receiving the penetrations of the reciprocating knife as well as maintaining a vacuum for the principal purpose of holding the stack in place and for the secondary purpose of evacuating the volume under the air impervious sheet.

All of these patented arrangements also suffer from the disadvantage that the air impervious sheet is cut in the process of cutting the stacked material layers with consequent loss of vacuum and thereby a loss of stability of the stack. And whereas certain of the Gerber patents describe means for "healing" the cut in the air impervious sheet behind the cutting member, these healing arrangements unduly complicate the overall cutting apparatus and/or are not totally successful in preventing loss of vacuum with a consequent loss of stability of the stack.

It has been proposed to use steel rule blanking or cutting dies with air evacuation compression so as to facilitate and improve the use of such dies to cut compressible materials. These proposals have involved the use of an air impervious cover or shroud positioned over a stack of compressible material positioned on the steel rule upper edge to define a vacuum chamber, and means for evacuating the vacuum chamber to compress and reduce the thickness of the stack of layers before cutting the layers with the steel rule. Such an arrangement is shown in U.S. Pat. Nos. 4,543,862, 4,694,719, 4,672,870 and 4,852,439, all assigned to the assignee of the present application. Whereas the method and apparatus disclosed in the latter patents is generally satisfactory for the cutting of compressible materials and has achieved significant commercial acceptance, the procedure of this patented process, whereby a large shroud of air impervious material is positioned over the stack of compressible material to form the vacuum chamber, is labor intensive and therefore contributes significantly to the overall cost of the process. Further, the shroud tends to wear with repeated usage and must eventually be replaced with the result that the materials cost of the process is thereby increased. Further, the necessity of providing vacuum equipment adds to the complexity and cost of the process.

SUMMARY OF THE INVENTION

This invention is directed to the provision of an improved method for cutting compressible materials using a steel rule die.

More specifically, this invention is directed to the provision of a method for cutting compressible materials with a steel rule die wherein the labor, material, and equipment costs of the process are minimized.

According to the invention method, an upper and lower platen are provided; an upstanding die is provided on the lower platen having a sharpened upper edge and having spaced portions defining an area therebetween; a stack of compressible material layers is placed on top of the upper die edge; the platens are moved together to compress the stack while maintaining the lower face of the stack substantially flat and at the level of the upper die edge; and the platens are moved further together while allowing the lower face of the stack to move downwardly between the die portions to thereby allow the layers to be moved through the die for cutting in the pattern defined by the die. This methodology ensures that the stack will maintain a precise rectangular configuration during the cutting process so as to ensure that each of the cut layers is of equal length and ensure that the cut edges are at right angles to the upper and lower faces of the cut layers.

According to a further feature of the invention, the step of maintaining the lower face of the stack substantially flat while compressing the stack comprises providing a surface between the die portions substantially flush with the upper edge and providing more resistance to downward movement of that surface than to compression of the stack. This methodology ensures that the surface between the die portions will remain in place during the initial compression of the stack so as to preclude downward bowing of the lower layers of the stack during the initial compression and the initial cutting operations.

According to a further feature of the invention, the step of providing a surface between the die portions substantially flush with the upper edge and providing more resistance to downward movement of the surface than to compression of the stack is performed by providing a compressible member between the die portions having an upper surface substantially flush with the upper edge and having a compressibility less than that of the uncompressed stack. This methodology ensures that the upper surface defined by the compressible member will not begin to move downwardly between the die portions until after the initial compression of the stack has been completed.

According to a further feature of the invention, the step of maintaining the lower face of the stack substantially flat during the initial compression of the stack comprises forming the compressible member as an open cell foam member so as to facilitate the escape therethrough of air trapped between the lower face of the stack and the upper face of the compressible member. This methodology precludes distortion of the lower face of the stack by trapped air during the initial compression process.

According to a further feature of the invention, vent openings are provided in the die portions so as to further facilitate the escape of trapped air.

In the disclosed embodiment of the invention, the die is upstanding from a base member and the vent openings in the die portions comprise notches in the die portions proximate the juncture of the die portions with the base member.

BRIEF DESCRIPTION OF THE DRAWINGS

FIG. 1 is diagrammatic view of a press employed in the invention methodology;

FIG. 2 is a perspective view of the lower press platen with a steel rule assembly;

FIG. 3 is a detailed view of a portion of the steel rule assembly of FIG. 2;

FIG. 4 is a perspective view of lower press platen with a steel rule assembly including associated foam members;

DETAILED DESCRIPTION OF THE PREFERRED EMBODIMENT

Figure 5:
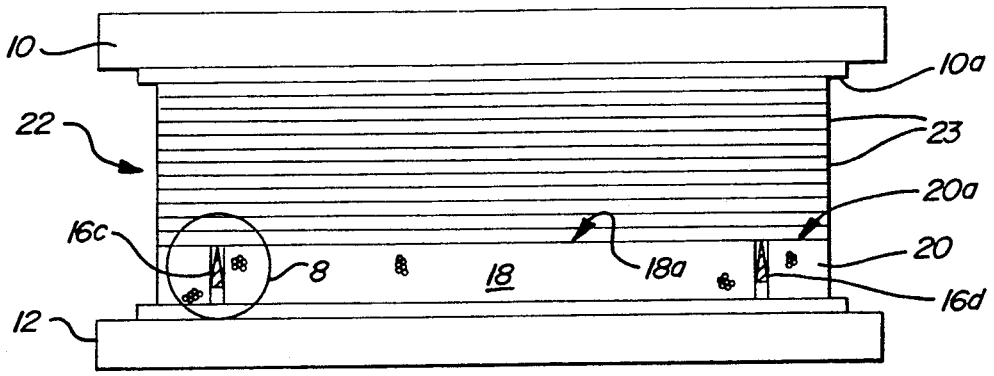
FIGS. 5, 6 and 7 illustrate successive steps in the invention cutting methodology.

The invention methodology is carried out utilizing a press including an upper platen 10 and a lower platen or bed 12 and a steel rule die assembly including a base board 14 and a steel rule die 16 upstanding from the baseboard 14 and having a sharpened upper edge 16*a*.

The die 16 may take various forms. For example, and as disclosed, it may form a closed loop of rectangular configuration including side sections 16*b*, 16*c*, 16*d* and 16*e*. As best seen in FIG. 3, the various die sections are received in slots 14*a* cut through baseboard 14 at spaced locations and coacting to provide a rectangular pattern of slots conforming to the rectangular configuration of the steel rule die. Notches 16*f* are formed along the lower edges of the die sections and have a height, as measured from the lower edge of the die, substantially greater than the thickness of the baseboard 14. The die sections are mounted on baseboard 14 by inserting the die portions 16*g* defined between successive notches 16*f* into the respective slots 14*a* to firmly seat the lower ends of die portions 16*g* on the upper face of bed or platen 12 and thereby firmly mount the die in upstanding fashion on the baseboard. With the die portions 16*g* inserted in the respective slots 14*a*, venting notches or passages 16*h* are formed in circumferentially spaced locations around the steel rule die proximate the juncture of the steel rule die with the base board 14.

The area between the steel rule die portions is filled by a generally rectangular foam member 18 and the area outside of the die is occupied by an annular foam member 20 of generally rectangular configuration. Members 18 and 20 have a height corresponding substantially to the height of the steel rule die so that the upper surfaces 18*a* and 20*a* of the members 18 and 20 are flush with the upper sharpened edge 16*a* of the die.

In carrying out the invention method, a stack 22 of compressible material layers 23 is placed on top of the steel rule die and on top of the upper surface 18*a*,20*a* of foam members 18,20.

The structure and composition of the foam members 18 and 20, and in particular the compressibility of the members 18 and 20 as compared to the compressibility of the stack 22, is critical to the successful operation of the invention methodology. Specifically, the foam members 18 and 20 must have a compressibility less than the compressibility of the uncompressive stack 22 so that during the initial compression of the stack of compressible materials 22, as the upper platen 10 is moved downwardly toward the lower platen 12, the upper surfaces 18*a* and 20*a* of members 18 and 20 remain substantially flat and substantially flush with the die edge 16*a*. Whereas the specific compressibility employed for the members 18 and 20 will vary depending upon the nature of the material being cut, for a typical cutting operation involving fabric with a foam backing or fabric with substantial nap, a compressibility value of between 130 and 150 lbs. IFD (Indentation Force Deflection) has been found to produce satisfactory results. Indentation Force Deflection, as established by ASTM Standard 3574, is determined by subjecting the upper face of a slab of material (for example 15 inch by 15 inch by 4 inch) to an indentor having a circular 50 square inch contact surface, compressing the slab 25% (for example from 4 inches to 3 inches), and measuring the final load in pounds after one minute.

It has also been found to be desirable to form the members 18 and 20 of an open cell, as opposed to a closed cell, configuration so as to allow the escape through the members 18 and 20 of air trapped between the upper faces 18*a*,20*a* of the members 18 and 20 and the lower face of the stack 22. An open cell foam material that has been found to be particularly effective in carrying out the invention methodology is available from Foamex Division of Knoll International Inc. of Fort Wayne, Ind. as Part No. S210-140. This particular material has a IFD of approximately 131 lbs. so as to successfully resist compression during the initial compression of the fabric stack and has a well established open cell configuration so as to allow the downward movement of trapped air through members 18 and 20 during the initial compression operation.

Figure 6:
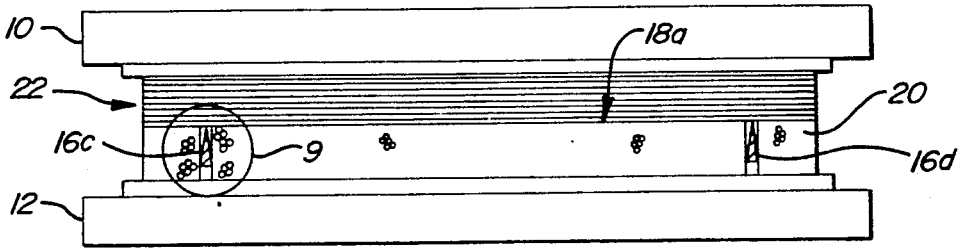
Figure 7:
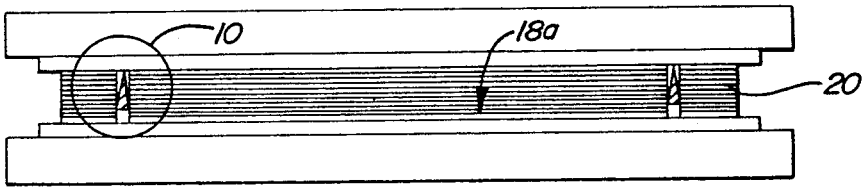
Figure 8:
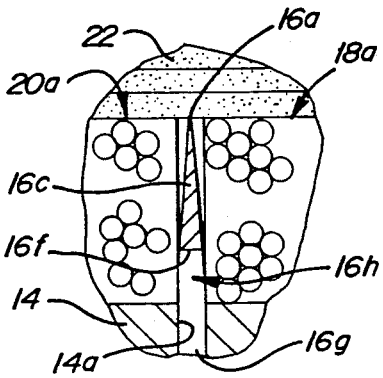
FIGS. 8, 9 and 10 are detailed views taken respectively within the circles 8, 9 and 10 of FIGS. 5, 6 and 7.
Figure 9:
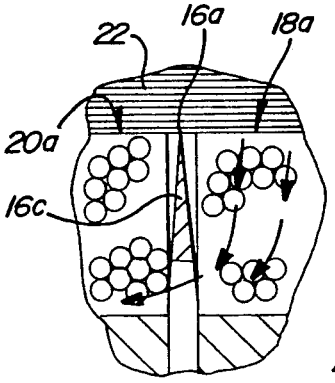
Figure 10:
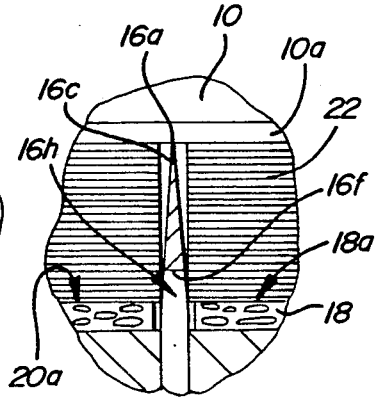
Figure 11A:
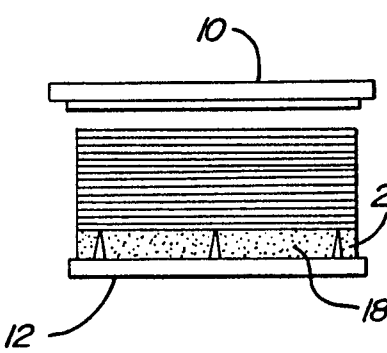
FIGS. 11 A–D illustrates successive steps in a prior art methodology.
Figure 11B:
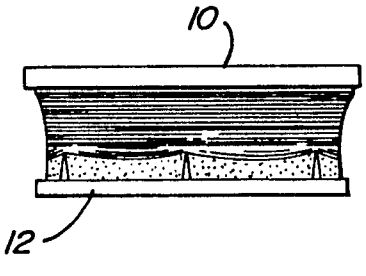
Figure 11C:
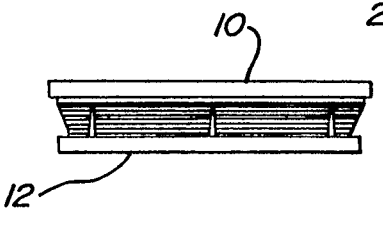
Figure 11D:
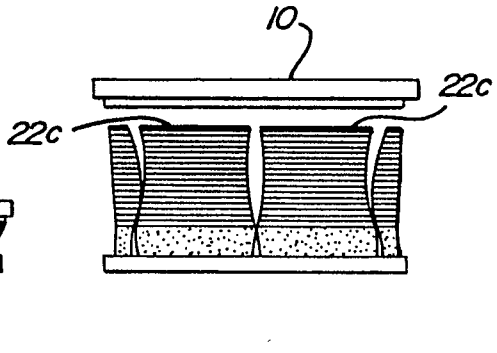
Figure 12A:
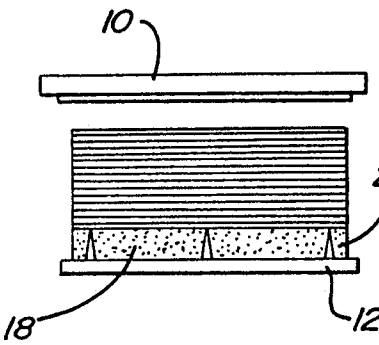
FIGS. 12 A–D illustrates successive steps in the invention methodology.
Figure 12B:
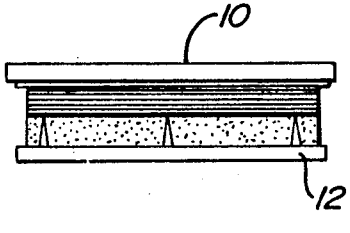
Figure 12C:
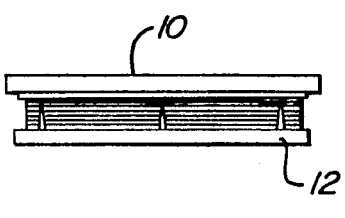
Figure 12D:
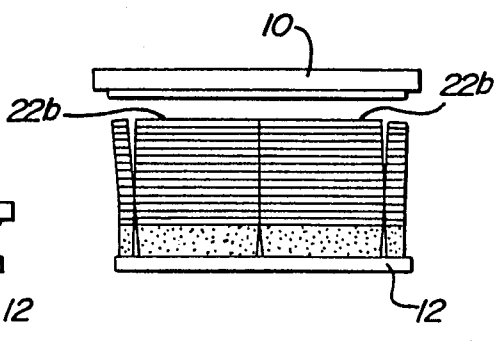

The operation of the invention methodology in successive steps is seen in FIGS. 5–7 as further amplified by detailed FIGS. 8, 9 and 10. The fabric stack 22 may comprise layers 23 of foam backed vinyl fabric and may, for example, have an initial height, as seen in FIG. 5, of nine inches. Following placement of the stack 22 on top of the sharpened upper edge 16*a* of the die and on top of the foam member upper surfaces 18*a* and 20*a*, upper platen 10*a* is moved downwardly in known manner to bring a cutting board 10*a* provided on the lower surface of platen 10 into contact with the upper surface of the uncompressed stack 22, whereafter further downward movement to the position seen in FIG. 6 serves to reduce the height of the stack to a compressed height of, for example, one inch. As seen in FIG. 6, the upper surface defined by the upper surfaces 18*a*,20*a* of members 18 and 20 is maintained in a flat disposition during this initial compression and is maintained at a level flush with the upper edge 16*a* of the die so as to preclude distortion of the fabric pile during the initial compression step. This is accomplished by careful selection of the compressibility factor of the members 18 and 20 as compared to the compressibility factor of the uncompressed stack as seen in FIG. 5 and the compressed stack as seen in FIG. 6.

It will be understood that the uncompressed stack as seen in FIG. 5 has a relatively high compressibility. That is, for a given application of a unit of pressure, the stack will undergo a relatively large change in volume or height. By contrast, the compressibility of the compressed stack, as seen in FIG. 6, is substantially lower since the compressed stack gradually takes on the characteristics of a stiff board as it undergoes the transition from the uncompressed condition of FIG. 5 to the compressed condition of FIG. 6. The compressibility of the foam members 18 and 20 is carefully and deliberately selected such that it is less than the compressibility of the uncompressed stack as seen in FIG. 5 but slightly greater than the compressibility of the compressed stack as seen in FIG. 6 so that, with further downward movement of platen 10 as seen in FIG. 7, members 18 and 20 compress downwardly in a uniform translatory manner so as to allow the fabric pile to be moved downwardly in a translatory manner through the die 16 with the fabric pile maintaining a rectangular configuration during the entire cutting operation so as to avoid distortion as between the various layers of the pile.

As the platen is moved from its initial FIG. 5 position to the FIG. 6 position corresponding to initial compression of the fabric pile, it is important that air trapped in the area beneath the pile and above the members 18 and 20 be allowed to readily escape from the system so as to avoid interference with, and distortion of, the lower face of the fabric pile. This is accomplished by providing an open cell construction for the members 18 and 20 so that air can move freely downwardly from the upper surface of these members for escape from the system, and by further providing vents or passages 16*h* along the lower portions of the die members so that the air escaping downwardly through the member 18 may escape radially outwardly through the vents 16*g* for escape from the system so that the air will not interfere in any way with maintaining a smooth, flat uniform interface as between the lower face of the fabric pile and the upper face of the members 18 and 20.

It will be understood that, following the cutting operation as seen in FIG. 7, the upper platen 10 will be moved upwardly to allow removal of the cut fabrics and that, as the platen moves upwardly, the members 18 and 20 will return to their initial positions, as seen in FIG. 5, in which the upper surfaces 18*a* and 20*a* are again disposed in a flush relationship with respect to the upper edge 16*a* of the die. The open cell configuration of the members 18 and 20 is of course important to this recovery ability as compared to closed cell configurations which exhibit crush characteristics without full recovery.

The various steps in the invention methodology are clearly seen by a comparison of the detailed FIGS. 8, 9 and 10. Specifically, in FIG. 8, representing the start of the invention process in which the stack 22 is in an uncompressed condition and has a compressibility greater than the compressibility of the members 18 and 20, upper surfaces 18*a* and 20*a* of members 18 and 20 coact to define a smooth, flat surface flush with the sharpened upper edge 16*a* of the die. As the stack 22 reaches its precompressed configuration, as seen in FIG. 9, these surfaces 18*a* and 20*a* continue to define a flat, smooth surface substantially flush with the upper cutting edge 16*a* of the die so as to preclude distortion of the lower layers of the stack. And as the stack achieves its precompressed configuration and the upper platen continues its downward movement, the upper faces 18*a* and 20*a* of members 18 and 20 move downwardly relative to the die in a uniform translatory manner so as to allow the lower layers of the stack to move downwardly relative to the die in a smooth translatory manner until the fully cut condition as seen in FIG. 10 is achieved. Since the stack 22 is at all times constrained to remain in a rectangular configuration with the upper faces of the stack parallel to the lower faces of the stack and the various layers 23 moving in a translatory manner relative to each other and relative to the total stack configuration, the various cut layers of the stack all have the same shape, width and length and the edges of each cut piece are substantially at right angles to the upper and lower faces of the piece.

The invention methodology is contrasted in FIGS. 11 and 12 with prior art cutting techniques including relatively soft foam members disposed between the spaced portions of the die. Specifically, in the invention methodology as illustrated in FIGS. 12*a* through 12*d*, embodying foam members 18 and 20 having an IFD of approximately 131 lbs., the stack 22 is maintained at all times in a rectangular configuration with the upper face of the stack parallel to the lower face so that the pieces 22*b* formed in the invention cutting operation, as seen in FIG. 12*d*, have a substantially uniform shape and length. By contrast, and as seen in FIG. 11 embodying the use of relatively soft foam members 18' and 20' between the die portions (for example foam material having an IFD of 35 lbs.), as the upper platen moves downwardly in the precompression step to reduce the height of the stack prior to the cutting operation, the lower face of the stack, between the die portions, bulges downwardly as permitted by the relatively soft foam members so that the pieces 22*c* produced by the cutting operation, as best seen in FIG. 11*d*, vary significantly in shape and length as measured from the top to the bottom of the pile. The distortion of the cut pieces in the prior art methodology as seen in FIG. 11 is thought to be due not only to the downward bulging of the lower face of the pile against the soft foam members positioned between the die portions but is also thought to be due to the fact that cutting of the fabrics begins during the precompression stroke rather than, as in the invention methodology, being precisely limited to the portion of the invention methodology occurring following completion of the precompression step. As a practical matter, the prior art methodology as seen in FIG. 11 produces satisfactory results in so long as the fabric pile 22 is relatively small, corresponding for example to no more than 5 or 6 plies of material, whereas the invention methodology, by contrast, produces excellent results, with virtually no distortion as between respective layers of the pile, with fabric piles containing several times the number of plies that can be successful cut utilizing the prior art methodology.

Whereas a preferred embodiment of the invention has been illustrated and described in detail, it will be apparent that various changes may be made in the disclosed embodiment without departing from the scope or spirit of the invention.

We claim:

1. A method for cutting compressible materials comprising the steps of:

providing upper and lower platens;

providing an upstanding die on said lower platen having a sharpened upper edge and having spaced portions defining an area therebetween;

providing a support surface in said area substantially flush with said upper die edge;

providing means for allowing the passage of air downwardly through said support surface;

placing a stack of compressible materials layers on top of said support surface and on top of said upper die edge;

maintaining said stack and said platens at ambient air pressure;

moving one of said platens toward the other of said platens to move said upper platen against the upper face of the uncompressed stack;

thereafter moving said one platen further toward said other platen to move said platens to a position substantially compressing said stack while pushing air trapped between said support surface and said stack downwardly through said support surface and maintaining said support surface substantially flush with said upper die edge; and thereafter moving said one platen still further toward said other platen while allowing said surface to move downwardly between said die portions to thereby allow said layers to be moved through said die for cutting in the pattern defined by said die.

2. A method according to claim 1 wherein:

said support surface providing step and said support surface maintaining step are performed by providing a compressible member in said area having an upper surface flush with said upper die edge to define said support surface and having a compressibility such that it undergoes virtually no compression during said step of substantially compressing said stack but thereafter compresses to allow its upper surface to move downwardly between said die portions to facilitate the cutting of the layers by the die.

3. A method according to claim 2 wherein;

said step of maintaining said support surface substantially flush with said upper die edge includes forming said compressible member of an open cell foam member so as to facilitate the escape downwardly therethrough of air trapped between said stack and said upper surface.

4. A method according to claim 3 wherein:

said step of maintaining said support surface substantially flush with said upper die edge further includes providing vent openings in said die portions so as to further facilitate the escape of trapped air.

5. A method according to claim 4 wherein said die is upstanding from a base member and wherein:

said vent opening providing step comprises forming notches in said die portions proximate the juncture of said die portions with said base member.

6. A method of cutting compressible materials comprising the steps of:

providing upper and lower platens;

providing an upstanding die on said lower platen having upstanding sidewalls, having a sharpened upper edge, having spaced portions defining an area therebetween, and having openings in the sidewalls thereof for the escape of air from said area;

placing a stack of compressible material layers on top of said upper die edge;

maintaining said stack and said platens at ambient air pressure;

moving one of said platens toward the other of said platens to move said upper platen against the upper face of the uncompressed stack;

thereafter moving said one platen further toward said other platen to compress said stack while pushing air downwardly into said space and thence radially outwardly for escape from said space through said openings and maintaining the lower face of said stack substantially flat and at the level of the upper die edge; and thereafter moving said one platen still further toward said other platen while allowing the lower face of said stack to move downwardly between said die portions to thereby allow said layers to be moved through said die for cutting in the pattern defined by said die.

7. A method according to claim 6 wherein:

said step of maintaining said lower face of said stack substantially flat while compressing said stack comprises providing a surface between said die portions substantially flush with said upper edge and providing more resistance to downward movement of said surface than to compression of said stack.

8. A method according to claim 6 wherein:

said step of maintaining said lower face of said stack substantially flat while compressing said stack comprises providing a compressible member between said die portions having an upper surface substantially flush with said upper edge and having a compressibility less than that of the uncompressed stack.

9. A method according to claim 8 wherein;

said step of maintaining the lower face of said stack substantially flat comprises forming said compressible member as an open cell foam member so as to facilitate the escape therethrough of air trapped between said stack and said upper surface.

10. A method according to claim 9 wherein:

said die is upstanding from a base member and wherein;

said openings comprise notches in said sidewalls proximate the juncture of said sidewalls with said base member.

11. A method of cutting a stack of compressible material comprising the steps of:

providing an upstanding die having a sharpened upper edge and having spaced portions defining an area therebetween;

placing a stack of compressible materials on said upper edge;

providing a compressible member between said die portions having an upper surface substantially flush with said upper edge and having a compressibility less than the compressibility of said stack in an uncompressed condition and greater than the compressibility of said stack in a compressed condition;

placing said die and said compressible member proximate one platen of a press having opposed platens;

maintaining said stack and said platens at ambient air pressure;

moving the other platen of the press toward said one platen to press said stack downwardly against said upper edge and against said upper surface of said compressible member to move said stack from its uncompressed to its compressed condition while said upper surface of said compressible member maintains the lower face of said stack substantially flat and substantially flush with said upper edge;

pushing air downwardly through said compressible member during the movement of said stack from its uncompressed to its compressed condition; and following the compression of said stack to its compressed condition, continuing to move said other platen toward said one platen to press said compressed stack downwardly through said die to cut said stack while said compressible member compresses downwardly between said die portions to facilitate the cutting action.

12. A method according to claim 11 wherein:

said step of providing a compressible member between said die portion includes forming said member of an open cell foam material so as to facilitate the escape downwardly therethrough of air trapped between said stack and said upper surface.

13. A method according to claim 12 wherein:

said step of providing a die includes providing vent openings in said die portions so as to further facilitate the escape of trapped air.

14. A method according to claim 13 wherein said die is upstanding from a base member and wherein:

said vent opening providing step comprises forming notches in said die portions proximate the juncture of said die portions with said base member.

15. A method according to claim 11 wherein:

said step of providing a compressible member between said die portions comprises providing an open cell foam member between said die portions having an Indentation Force Deflection of between 120 and 150 lbs.

16. A method according to claim 15 wherein:

said step of providing a member between said die portion comprises providing an open cell foam member having an Indentation Force Deflection of approximately 130 lbs.

* * * * *